US010767415B2

(12) United States Patent
Coe et al.

(10) Patent No.: US 10,767,415 B2
(45) Date of Patent: Sep. 8, 2020

(54) EMERGENCY SCHOOL DOOR BARRICADE RETROFIT SYSTEM APPARATUS AND METHOD

(71) Applicants: Brian Coe, Slidell, LA (US); Ricky Coe, Slidell, LA (US)

(72) Inventors: Brian Coe, Slidell, LA (US); Ricky Coe, Slidell, LA (US)

( * ) Notice: Subject to any disclaimer, the term of this patent is extended or adjusted under 35 U.S.C. 154(b) by 6 days.

(21) Appl. No.: 16/034,816

(22) Filed: Jul. 13, 2018

(65) Prior Publication Data

US 2020/0018112 A1 Jan. 16, 2020

(51) Int. Cl.

| | |
|---|---|
| ***E06B 5/10*** | (2006.01) |
| ***E05C 19/00*** | (2006.01) |
| ***E06B 7/30*** | (2006.01) |
| ***E06B 9/04*** | (2006.01) |
| ***E06B 7/28*** | (2006.01) |
| ***E05B 15/16*** | (2006.01) |

(52) U.S. Cl.

CPC ..... *E06B 5/10* (2013.01); *E05B 15/1614* (2013.01); *E05C 19/003* (2013.01); *E06B 7/28* (2013.01); *E06B 9/04* (2013.01)

(58) Field of Classification Search

CPC ..... F41H 5/06; F41H 5/24; F41H 5/26; E06B 5/10; E06B 7/28; E06B 9/04; E06B 7/30; E06B 3/362; E05C 19/003; E05C 19/004; E05C 19/005; E05B 15/1614

USPC ..... 109/11–13, 17, 18, 49.5; 292/259 R, 292/260, 288, 289, 338, 339; 49/49, 163, 49/164, 168, 169, 171; 89/36.01, 36.04, 89/918, 920, 936; 70/94, DIG. 64, 70/DIG. 65, DIG. 66

See application file for complete search history.

(56) References Cited

U.S. PATENT DOCUMENTS

| | | | | |
|---|---|---|---|---|
| 258,833 | A * | 5/1882 | White | |
| 1,260,469 | A * | 3/1918 | Smith | E05B 65/0864 292/153 |
| 1,344,444 | A * | 6/1920 | Edman | 292/259 R |
| 2,624,922 | A * | 1/1953 | Ackerman | E06B 7/30 49/38 |
| 2,751,858 | A * | 6/1956 | Koranda | B61D 7/22 105/282.2 |
| 3,423,974 | A * | 1/1969 | Bernsley | E05B 13/002 70/416 |
| RE27,161 | E * | 8/1971 | Raymon | E05B 65/0888 49/449 |

(Continued)

*Primary Examiner* — Lloyd A Gall

(74) *Attorney, Agent, or Firm* — Keaty Law Firm LLC

(57) ABSTRACT

A reinforcement system and method for a door having a window provides for a window shutter that slides into a position covering the window during a shooting incident. An elongated bar has one end pivotally supported by a securing bracket, which is attached to a wall adjacent the door. A release pin is attached to the securing bracket; it normally supports the bar in a vertical stored position. A holster is secured to the wall on the opposite side of the door in alignment with the securing bracket. The shutter, the securing bracket, and the holster are formed from a ballistic resistant material. During a shooting incident, the user moves the shutter to cover the window, removes the release pin and pivots the bar into a horizontal position barring the door. The free end of bar is received in the holster, thereby reinforcing the door independently of the door frame and door hinges.

20 Claims, 6 Drawing Sheets

(56) References Cited

U.S. PATENT DOCUMENTS 3,724,246 A * 4/1973 Katsaros ..... E05B 13/002 70/431
3,748,882 A * 7/1973 Dusault, Jr. ..... E05B 13/001 70/416
3,809,417 A * 5/1974 Craig ..... E05C 19/003 292/259 R
3,937,503 A * 2/1976 Harris ..... E05C 1/04 292/153
4,067,598 A * 1/1978 Mansour ..... E05C 19/003 292/259 R
4,082,332 A * 4/1978 Palmer ..... E05C 19/003 292/259 R
4,127,967 A * 12/1978 Franzl ..... E06B 7/28 16/82
4,268,074 A * 5/1981 Alexander ..... E05B 65/0864 292/149
4,314,721 A * 2/1982 Clark ..... E05B 65/0888 292/262
4,570,985 A * 2/1986 Waldo ..... E05B 65/0888 292/262
4,763,444 A * 8/1988 Ritchie ..... E06B 7/30 49/171
5,007,669 A * 4/1991 Pomerleau ..... E05B 17/0025 292/207
5,447,345 A * 9/1995 Daley ..... E05C 19/003 292/259 R
5,461,827 A * 10/1995 Lofton ..... E06B 9/02 49/55
5,474,343 A * 12/1995 Ledbetter ..... E05C 19/003 292/259 R
5,582,656 A * 12/1996 Kangas ..... C22C 38/44 148/325
5,791,173 A * 8/1998 Montes ..... E05C 19/003 292/259 R
8,850,949 B1 10/2014 Lopez
9,145,729 B2 9/2015 Spransy
9,243,445 B2 1/2016 Beaudoin
9,644,408 B2 5/2017 Presutti
2008/0263958 A1 10/2008 Edson
2009/0102205 A1* 4/2009 Carr ..... E05C 19/003 292/259 R
2010/0155001 A1* 6/2010 Bolton ..... G09F 3/20 160/368.1
2012/0326457 A1* 12/2012 Mead ..... E05C 19/003 292/259 R
2015/0215755 A1 7/2015 Bekanich
2015/0300784 A1* 10/2015 Scarinci ..... F41H 5/013 89/36.02
2016/0281416 A1 9/2016 Spransy
2017/0191306 A1 7/2017 Falesch et al.
2019/0145139 A1* 5/2019 Keller ..... E05C 19/003 292/259 R

* cited by examiner

EMERGENCY SCHOOL DOOR BARRICADE RETROFIT SYSTEM APPARATUS AND METHOD

BACKGROUND OF THE INVENTION

This invention provides a retrofittable emergency barricade system to be used in conjunction with windowed school doors. This system closes off the line of sight and prevents entry and attack into the room through the door window, while also barring the door itself closed to entry in a manner not wholly dependent on door lock or hinge integrity.

In the United States, a school door is typically a door with a small vertical window at head height. The school window is shutterless and the door typically opens inward. The window on the door is a safety measure allowing the room to be checked while being used during the daily operation of the school. However, in the case of an active school shooter, the window becomes a danger. Suddenly, locking the door is not enough to prevent harm to the room, as a shooter may see the room filled with people or a specific person they are targeting through the window and be motivated to breach the window to reach the lock or to otherwise compromise the integrity of the lock. For instance, the Parkland, Fla. shooter at Marjory Stoneman Douglas High School shot through the windows at fellow students. Clearly, merely providing a barrier to entry, although important, is not enough to protect students in the case of a school shooting. Any barrier system must present an effective barrier, taking not only the door into account but the door window as well. It must not interfere with normal use of the door, and because of the quickness in which a situation can arise and the varying physical ability of the teachers and students inside the room, an effective barrier system must be quick and easy to operate across a high range of physical abilities without much forethought by the operator beforehand.

An emergency barricade system used as a barrier to prevent school shootings should be ballistic resistant. Although ballistic resistance varies, Underwriters Laboratories (UL), an independent standards developer and audited designator accredited by the American National Standards Institute (ANSI), has defined eight levels of ballistic resistance for ballistic resistant products. Level 1 material survives at least three shots of 9 mm Full Metal Copper Jacket with Lead Core ammunition fired at up to 1293 feet per second. Level 2 material survives at least three shots with 158 grain 0.356 Magnum Jacket Soft Lead Point ammunition fired at up to 1375 feet per second. Level 3 material survives at least three shots of 240 grain 0.44 Magnum Lead Semi-Wadcutter Gas Checked ammunition fired at up to 1485 feet per second. Level 3 material is considered suitable for providing safety in industries susceptible to armed robberies such as banks and credit unions as it provides protection up to the level of resisting 0.44 magnum handguns. Level 4 material survives at least one shot of 180 grain 0.30 Caliber Rifle Lead Core Soft Point (0.30-06 Caliber) ammunition fired at up to 2794 feet per second. Level 5 material survives at least one shot of 150 grain 7.62 mm Rifle Lead Core Full Metal Copper Jacket, Military Ball (0.308 Caliber) ammunition fired up to 3025 feet per second. Level 6 material survives five shots of 124 grain 9 mm Full Metal Copper Jacket with Lead Core ammunition fired at up to 1540 feet per second. Level 7 material survives five shots of 55 grain 5.56 mm Rifle Full Metal Copper Jacket with Lead Core (0.223 Caliber) ammunition fired at up to 3388 feet per second. Level 8 material survives five shots of 150 grain 7.62 Rifle Lead Core Full Metal Copper Jacket, Military Ball (0.308 Caliber) ammunition fired at up to 3025 feet per second. Thus, the levels are determined by a mix of factors including ammunition type, feet-per-second, weight, and number of shots. A minimum of Underwriters Lab (UL) level 3 or an equivalent from a nationally accredited and audited designator should be provided in providing ballistic resistance to deter school shooters.

Although there are some barricade systems that were developed for use in schools for preventing intruder access through the door, the Parkland, Fla. shooter demonstrated the flaws in these systems by both identifying targets and shooting through windows. The previous systems rely on lock hinge or hinge integrity entirely or do not address the shooter's use of door windows and thus are not truly effective barriers to school shooters.

For example, U.S. Patent Application Publication No. 2016/0281416 was published on Sep. 29, 2016. Applicant DAW Technologies, LLC applied for "Classroom Retrofit Barriers," as conceptualized by inventor Peter J. Spansy. Here, a ballistic door providing barrier-of-entry shielding blocks a doorway in certain emergency situations to shield against active shooters, while not inhibiting, impeding or changing the safe egress through the ballistic door. A ballistic assembly may be secured to the non-threat side of an existing door, by retrofit installation or by new construction installation. The ballistic assembly has a ballistic skin, a top ballistic skin clamp, and a bottom ballistic skin clamp. The top and bottom ballistic skin clamps secure the ballistic skin against the non-threat side of the door. The ballistic door has at least a N.I.J. Level IIIA of protection against gunfire. More particularly, it is disclosed that the classroom ballistic barriers provide barrier-of-entry shielding that may be retrofit to the existing classroom door by the school's own maintenance staff and will not inhibit emergency exits through the door. The system and method combine a minimally-thick ballistic skin with a solid-core wood as is typically used as a classroom door to create a shield equivalent to a N.I.J. Level IIIA ballistic panel. Hence, it is possible to retrofit a relatively thin ballistic skin onto an existing door to provide protection against multiple 0.44 magnum and 9 mm handgun blasts, as well as multiple 12-gauge shot gun blasts. The ballistic skin may comprise ballistic fiberglass reinforced plastic (FRP) material. For N.I.J. Level IIIA protection, the door and ballistic skin combination, constituting the ballistic door, must stop five rounds from a 0.44 magnum or five rounds from a 9 mm handgun within a 12"×12" square shot 16 feet 4 inches away, with no penetrations. Normally, to achieve N.I.J. Level IIIA protection with this type of material, it would require a minimum of a ½" thickness of FRP. Because FRP material weighs approximately 6 pounds per square foot, providing that thickness would add too much weight to the door, would make it difficult for a single maintenance person to install, and would add unnecessary cost. However, by applying the ballistic skin 18 of a ¼" thickness to an existing door, the weight of the ballistic shielding is cut in half making it capable of installation by a single maintenance person, and the cost of the shielding is significantly reduced. Moreover, by using lightweight (thinner) ballistic material, the added weight will not fatigue the existing door, nor will the shielding protection provided be exorbitantly expensive for schools, offices, or the like. The use of lightweight (thinner) ballistic material, while not surrendering ballistic integrity for the door, is possible by always placing the ballistic material on the non-threat side of the door. This enables the solid core wood door to assist with and perform some of the work if stopping bullets.

U.S. Pat. No. 9,243,445 entitled "Protective Window Shutter," issued on Jan. 26, 2016, to inventor Stephen Beaudoin. Here, a protective window shutter is designed to cover and uncover a door mounted "peek through" metal framed window. The shutter is made up of two shutter sections, rotatable in relation to each other. The first shutter section is secured adjacent to the window's metal frame and the second shutter section is rotatable from a first position in which the two sections are folded on each other, to a second position in which the second section is extended out from the first section, over the window. The shutter sections are maintained in the closed position by the attraction of metal strike plates on the first shutter section and corresponding magnets encased within the second shutter. The second section is maintained over the window by the attraction of the magnets to the window's metal framing. The shutter sections are made of high strength, lightweight PVC or like material.

U.S. Patent Application Publication No. 2008/0263958 was published on Oct. 30, 2008, disclosing a "Classroom Fortification System." Inventor Frederick Can Edson conceptualized a device and method for preventing entry into a room having an upper window such as a school classroom door. Specifically, the device is an entry resistant material positioned on the lower part of the inside of the classroom door which can be moved into position over the inside of the classroom door window and prevent or resist entry into the window and optionally restrict viewing into the classroom.

U.S. Pat. No. 9,644,408 for a "Method and Device for Barricading a Door," as issued on May 9, 2017, provides for a barricade device and a method of barricading a door, each conceptualized by inventor Michael Presutti. More specifically, the device and method may be used to barricade a door, and thereby prevent an intruder from entering a sheltering space, such as a classroom, storeroom, or hallway. The barricade-device may have a pivotable stop-device that is pivotable from a location adjacent to a door. The pivot-location may be at an elevation that is lower than a door handle on the door. The stop-device may be pivotable from a reserve-position to a stop-position. In the reserve-position, the stop-device does not barricade the door. In the barricade-position, the stop-device barricades the door.

U.S. Pat. No. 9,145,729 issued on Sep. 29, 2015 to assignee DAW Technologies, LLC for "Classroom Ballistic Barriers." Inventor Peter J. Spransy conceptualized a classroom barrier comprising a sliding panel or hinged panel designed to block a classroom door or window opening in certain emergency situations such as the presence of an armed assailant. The barrier is locked from the inside with no chance for it to be unlocked from the exterior. The classroom barrier is simple to operate, bullet resistant, and impenetrable for some predetermined length of time.

U.S. Patent Application Publication No. 2015/0215755 for a "School-Wide Lockdown and Emergency Communication System" was published on Jul. 30, 2015 in relation to the system of inventor Joseph Bekanich. Here, disclosed is a multi-format emergency communication service for a school, office or home which allows for a non-law enforcement person to send a pre-defined location-based emergency digital message through a graphic user interface to a 911 emergency dispatcher or law enforcement individual and concurrently connect to the same 911 emergency dispatcher or law enforcement individual through a secure 2-way audio/video interface and messaging service. Additionally, a specially configured lockdown system/hardware will work in concert with the aforementioned emergency communication methods to lockdown and secure the door(s), window(s) or entry points at the said emergency location. More specifically, claimed is a hardware-implemented lockdown system that comprises a door bar system which secures or lockdown one or more doors, windows or entry points from entry during an emergency or crisis.

U.S. Patent Application Publication No. 2017/0191306, entitled "Removable Ballistic-Resistant Door Barricade," published on Jul. 6, 2017, disclosing the door barricade of inventors Alex J. Falesch, Ryan Walsh, and Christopher LeClair. Here, provided is a door barricade configured to secure a door from an outside threat can include a ridged bulletproof plate. The door barricade can be connected to the door via a fastener. In some embodiments, the fastener is an L-bracket. In other embodiments, the fastener is a ballistic nylon mechanism. The door barricade can also include at least one crossbar and at least one foot to help prevent the door from being forced open. The door barricade can also include a carrying handle to allow for easier deployment of the barricade. In some embodiments, the plate can include a door handle notch that can be covered with a door handle cover. In other or the same embodiments, a door skirt is present. In some embodiments, side panels are attached to the barricade via mounting brackets.

Lastly, U.S. Pat. No. 8,850,949 was issued on Oct. 7, 2014 to inventor Lois A. Lopez for a "Safety Door for Classrooms and the Like." The '949 Patent discloses a door safety shield that completely overlies a door having a frame and a doorknob, replaceabley and slidably attaches to the frame of the door and not the door so as to eliminate damage to the door and prevents unauthorized opening of the door. The door safety shield includes a sheet and bolt assemblies. The sheet completely overlies the door. The bolt assemblies are affixed to the sheet, replaceabley and slidably attach to the frame of the door and not the door so as to eliminate the damage to the door and prevent the unauthorized opening of the door.

While the above discussed approaches may be beneficial in certain circumstances, there exists a need for an easy-to-operate, effective system of retrofitting classroom doors with a protective shield to restrict physical access of a potential criminal to the people in the classroom.

SUMMARY OF THE INVENTION

This invention provides a retrofittable emergency barricade system to be used in conjunction with windowed school doors.

It is, therefore, an objective of the present invention to deny line of sight into the room through the window of a windowed door during a shooting incident, by providing a ballistic-resistant shutter for windowed school doors.

It is further an objective of the present invention to deny line of fire through the window of a windowed door during a school shooting, by providing a ballistic resistant shutter for windowed school doors.

It is further an objective of the invention to bar entry to a schoolroom in a manner not wholly dependent on door lock or hinge integrity, by providing a bar and bar mounts which attach to the door frame or wall around the door frame.

It is further an objective of the present invention to allow windowed doors to remain clear and unobstructed under normal school conditions, so to allow school staff to maintain the integrity of the schoolroom under such conditions.

It is further an objective of the present invention to provide a protective system that can be easily engaged in a manner of seconds by someone with limited physical ability, thereby decreasing the time and chances the room is unprotected in a shooter situation.

It is further an objective of the present invention to provide a classroom door protection system retrofittable across the range of windowed school doors, including windowed double-wide school doors, and form an affordable and effective barrier system.

The present invention achieves these objects by providing a door protection assembly, which comprises a bar positioned next to the door frame; a holster or holsters attached to the door frame or next to the door frame which allows the bar to be laid horizontally across the doorway; and a sliding ballistic window shutter. The present invention provides an easy to operate but strong and reliable system of securing a room. The system secures a room by denying line of sight and the ability to open or shoot through the window, as well as removing the possibility of taking advantage of a broken window to unlock the room while further preventing entry to the room by barring the door. The system can be engaged to secure a room in a manner of a few seconds by anyone across a high range of physical abilities without much preparation or training. The system of the present invention is retrofittable and adjustable to fit a variety of school doors.

BRIEF DESCRIPTION OF THE DRAWINGS

Reference will now be made to the drawings, wherein like parts are designated by like numerals, and wherein.

DETAILED DESCRIPTION OF THE INVENTION

Figure 1A:
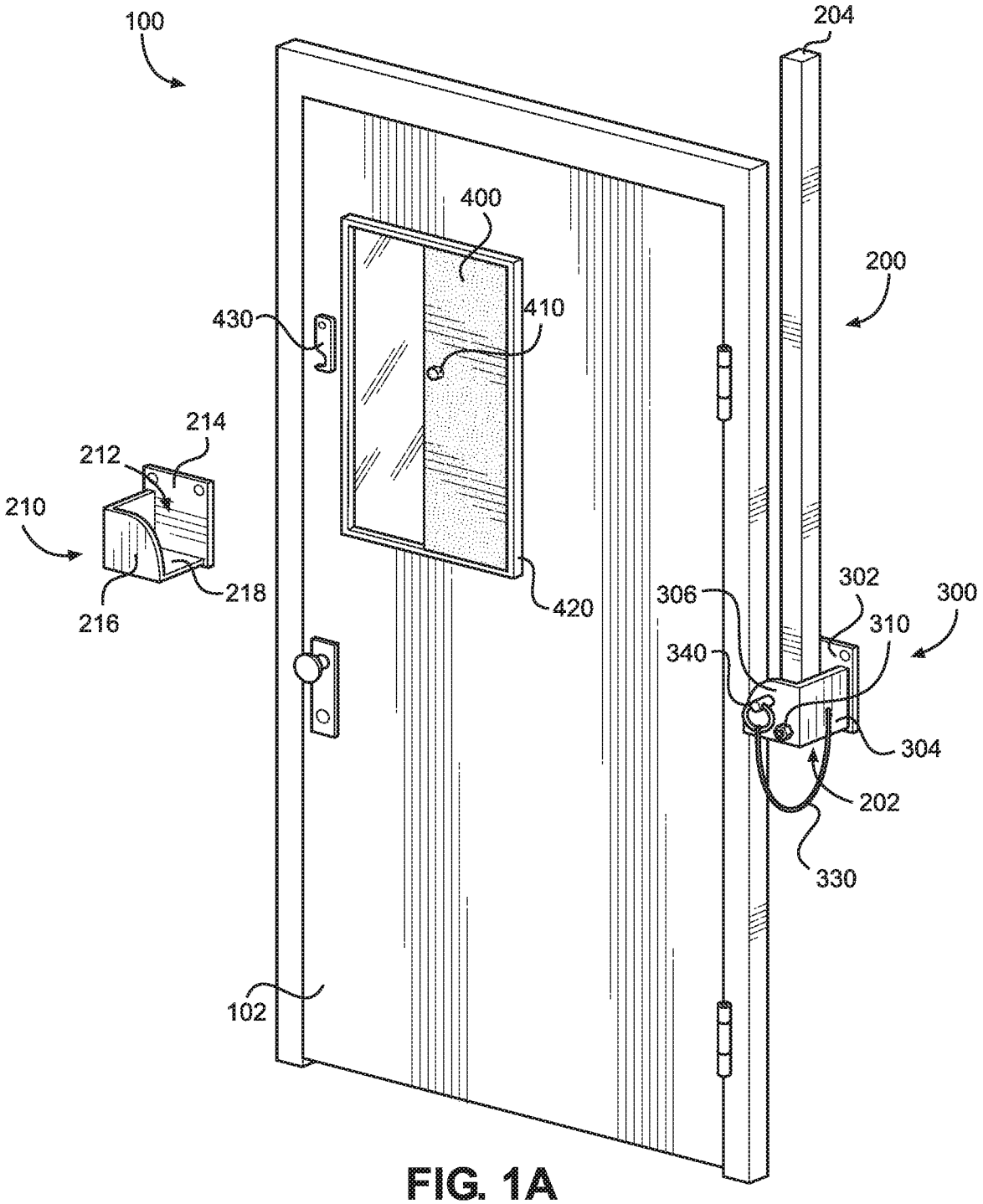
FIG. 1A is a perspective view of the emergency school door barricade system of the present invention retrofitted to a windowed school door, in a disengaged state.
Figure 1B:
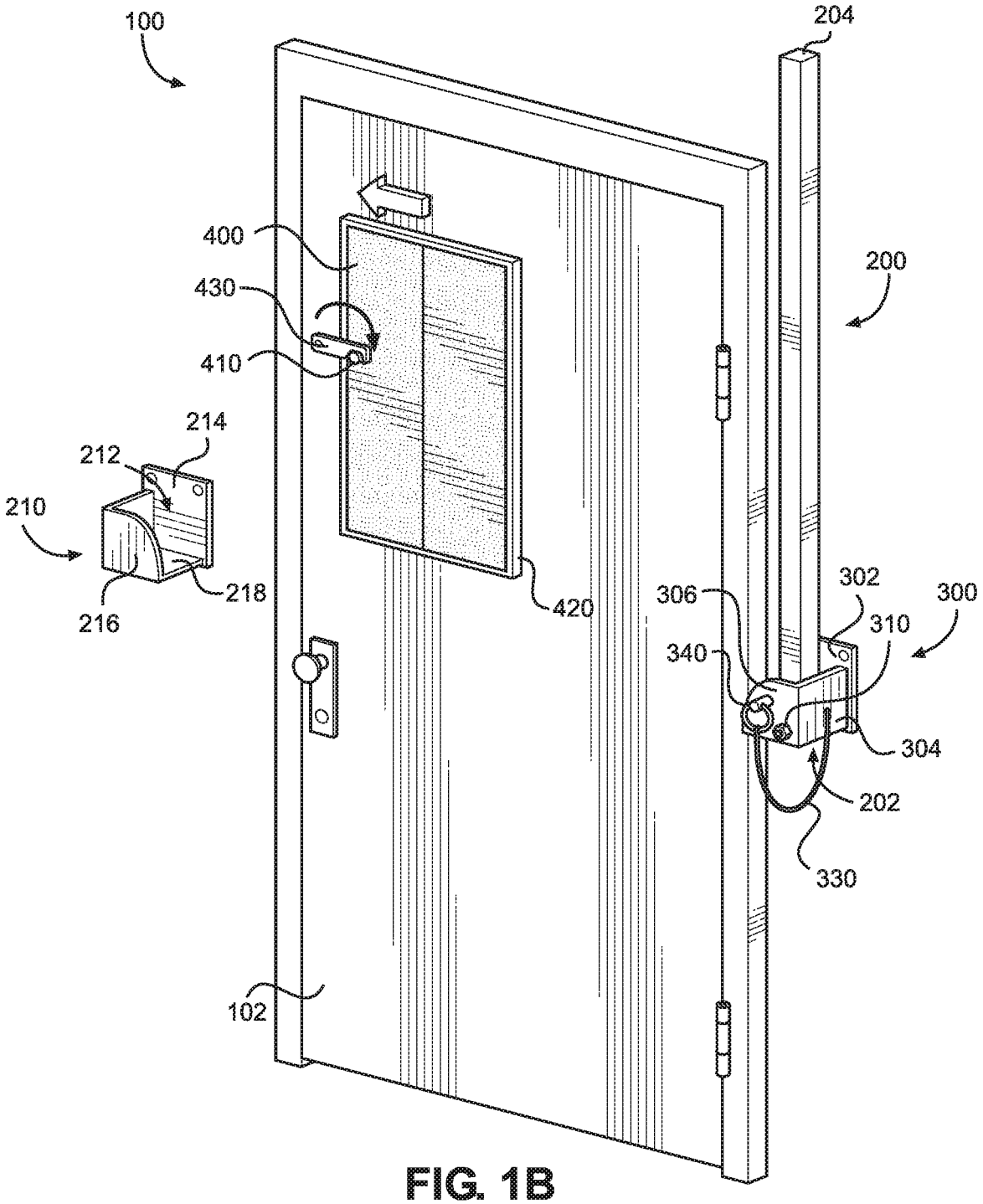
FIG. 1B is a perspective view of the emergency school door barricade system of the present invention retrofitted to a windowed school door, in a partly engaged state, wherein the ballistic shutter is closed.
Figure 1C:
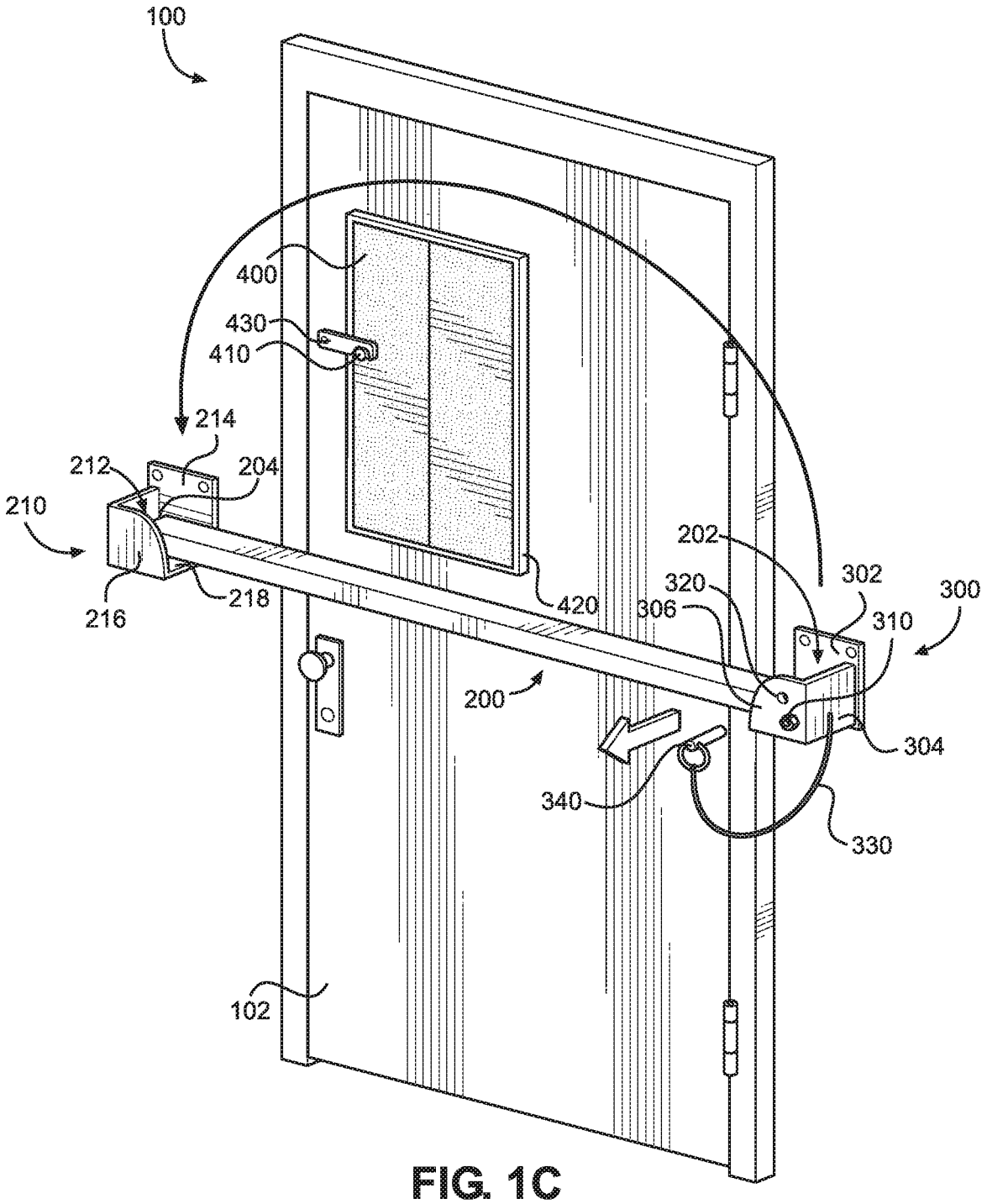
FIG. 1C is a perspective view of the emergency school door barricade system of the present invention retrofitted to a windowed school door, in a fully engaged state.
Figure 2A:
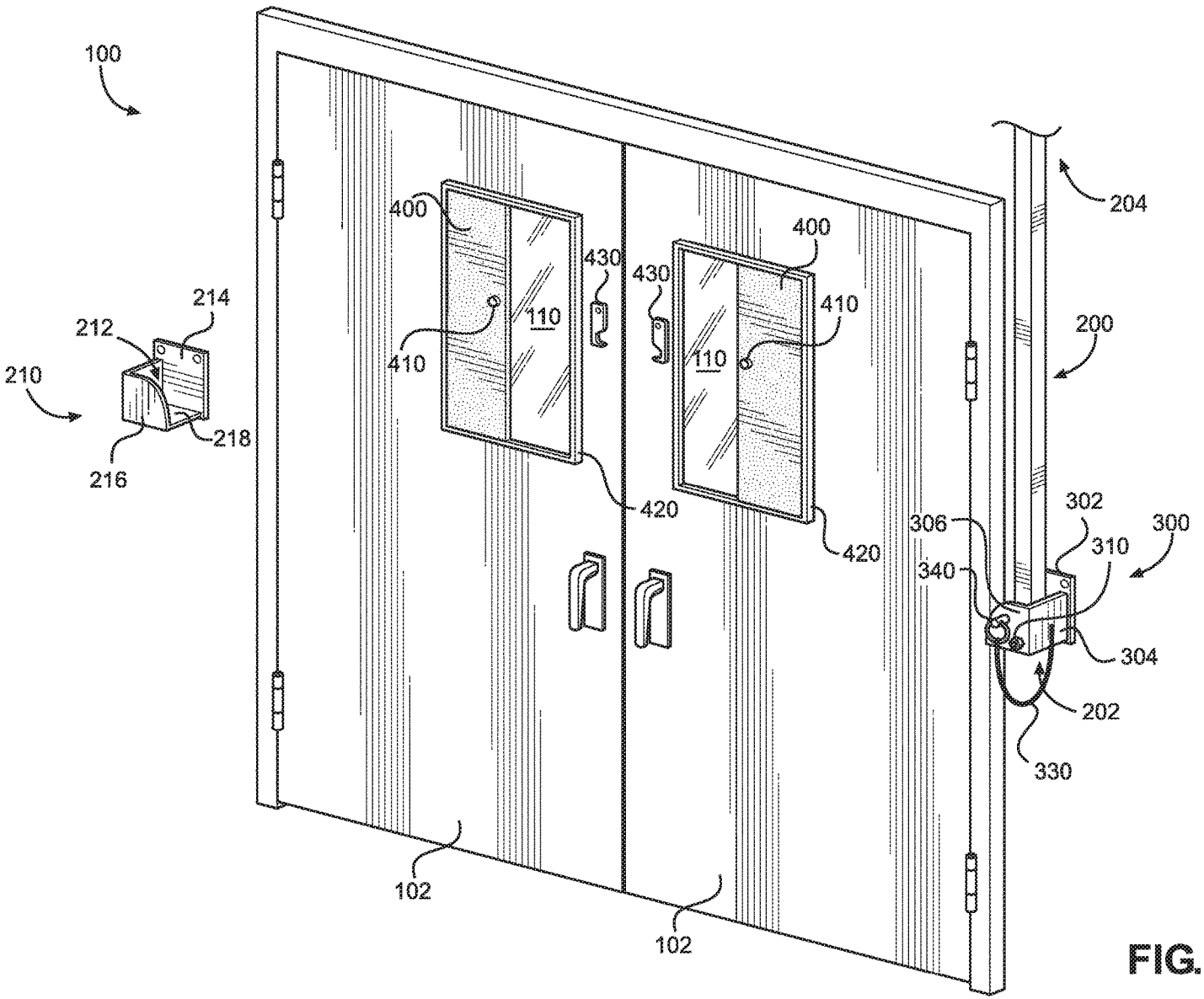
FIG. 2A is a perspective view of the emergency school door barricade system of the present invention retrofitted to a double-wide windowed school door, in a disengaged state.
Figure 2B:
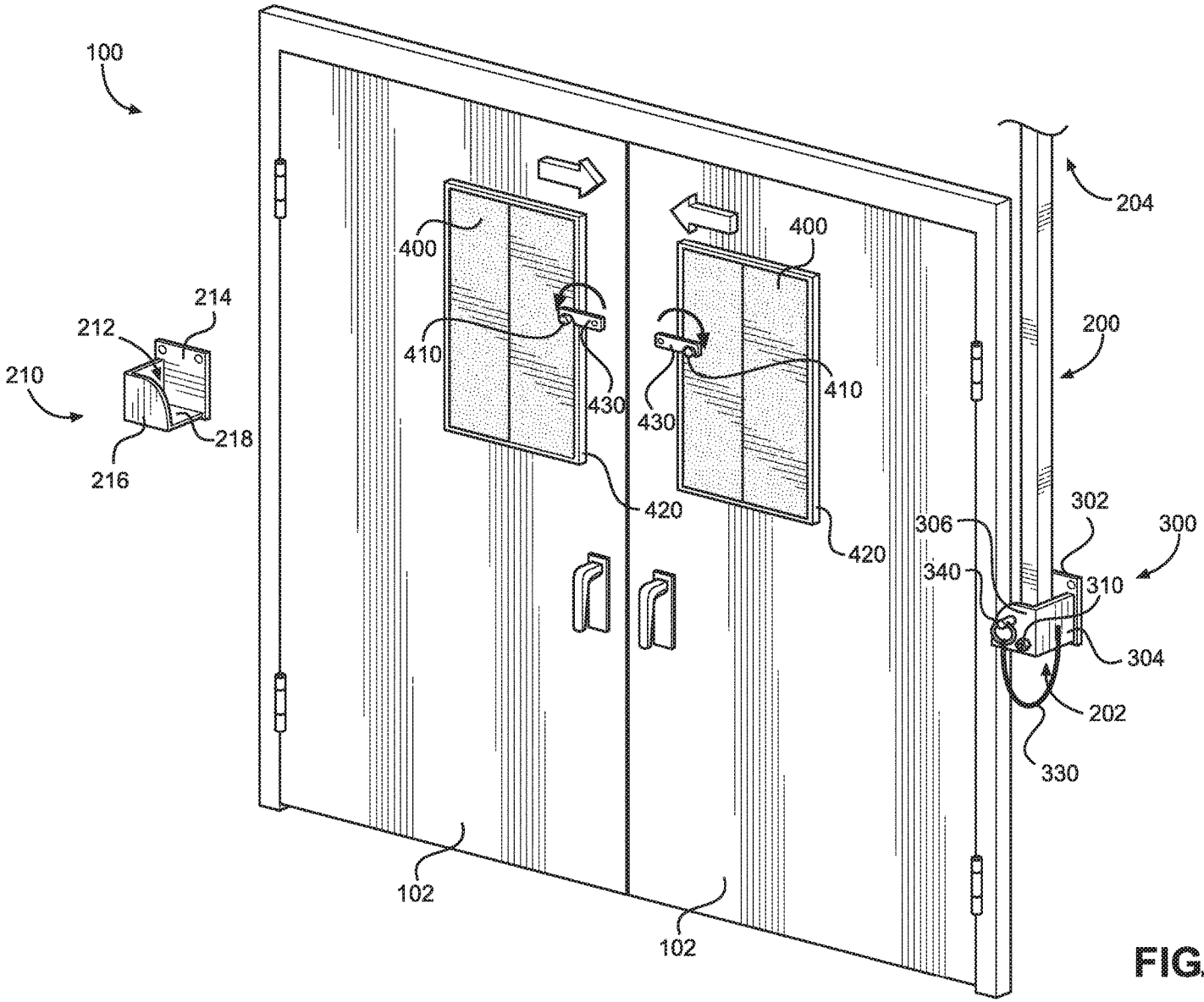
FIG. 2B is a perspective view of the emergency school door barricade system of the present invention retrofitted to a double-wide windowed school door, in a partly engaged state, wherein the ballistic shutter is closed.
Figure 2C:
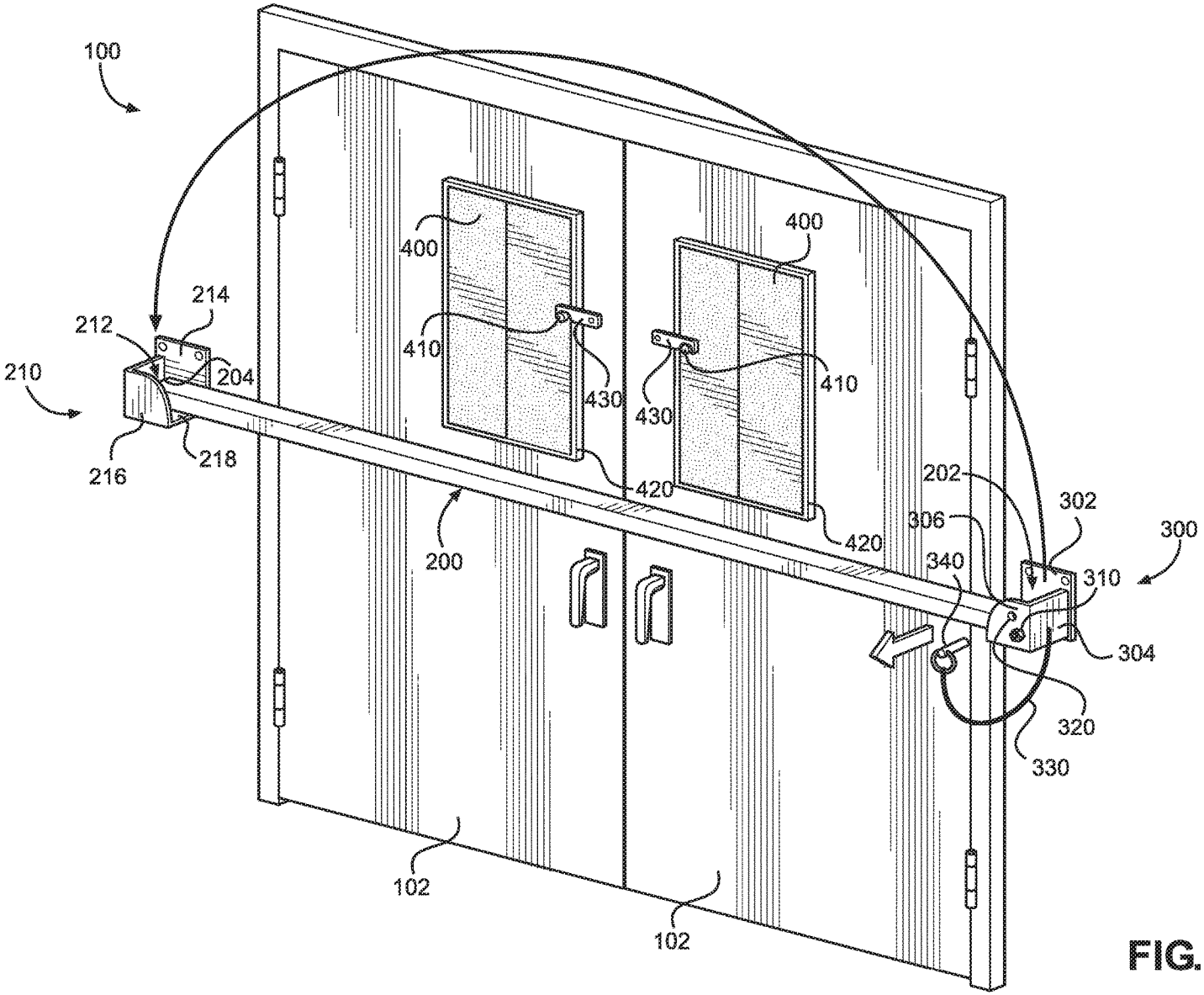
FIG. 2C is a perspective view of the emergency school door barricade system of the present invention retrofitted to a double-wide windowed school door, in a fully engaged state.

Referring to FIGS. 1A, 1B, 1C, 2A, 2B, and 2C generally, the figures depict a perspective view of the emergency school door barricade retrofit system 100 of the present invention from the perspective of a person in a school room. The emergency door barricade retrofit system comprises two main sections: the window shutter section and the barricade section. The window shutter section comprises a ballistic shutter member 400, a shutter handle 410, and a shutter frame 420. The barricade section comprises a bar 200, a bar holster 210, as well as a securing bracket 300. All parts of the present invention are ballistic resistance material equivalent to or greater than a UL level 3 ballistic rating, preferably of steel. The emergency school door barricade retrofit system may be modified in terms of scale to retrofit to a variety of doors 102 and door windows 110. The system of the present invention can be retrofitted to many door styles including doors covering double-wide entryways such as windowed double-wide doors as illustrated in FIG. 2A, FIG. 2B, and FIG. 2C.

The invention has three states disengaged, engaged, and partly engaged. In a disengaged state, as can be seen in FIG. 1A and FIG. 2A, the system of the present invention remains when there is no emergency. In an engaged state, as shown in FIG. 1C and FIG. 2C, the system of the present invention is activated during a time of emergency such as an intruder or school shooter. In a partly engaged state, as illustrated in FIG. 1B and FIG. 2B, the system of the present invention appears when the system is in the process of being engaged or disengaged by student, faculty, or other persons. In the preferred embodiment of the invention, going from disengaged state of FIG. 1A or 2A to the engaged state of FIG. 1C or FIG. 2C is done in no more than a few seconds.

The ballistic shutter member 400 comprises a ballistic plate sized to fit directly over and cover the window 110. The shutter frame 420 is configured to substantially extend to the edges of the window 110 and about an area that allows the ballistic plate to fit in the ballistic frame while beside and not covering the window 110. The shutter frame 420 enables the ballistic shutter member to be manually moved within the frame using the handle 410 to cover the window 110. All parts of the ballistic frame 420 and the ballistic plate are preferably formed from steel or of a material composition and thickness equivalent or greater to UL level 3 rating. In one of the preferred embodiments, the ballistic shutter member 400 is preferably formed from ¼-inch steel having a composition and thickness with ballistic resistance equivalent to or greater than a UL level 3 ballistic rating.

The UL level 3 rating, which stops three 0.44 magnum shots, is generally considered the sufficient level for the needs of those in industries which suffer from armed robberies. A barricade system designed to stop a shooter should have at least a level 3 UL ballistic rating or an equivalent from a nationally accredited and audited designator overall. In the preferred embodiments of the present invention, this material is preferably steel of a material composition and thickness such as to meet or exceed the UL level standard.

Thus, the ballistic shutter member 400, which closes off line of sight, is also adapted to provide at least UL level 3 ballistic resistance: significantly helping to prevent a shooter from shooting through the door window 110.

The shutter plate handle 410 attaches to the ballistic shutter member 400 and has a thickness and material composition with a ballistic resistance equivalent to or greater than a UL level 3 ballistic rating, preferably of steel. The plate handle 410 allows for the ballistic plate to be moved within the ballistic shutter frame 420 to a position covering the window 110. The plate handle 410 is easily accessible to persons inside the classroom.

A latch 430, also of ballistic resistant material with a ballistic resistance equivalent to or greater than a UL level 3 ballistic rating, preferably of steel, is designed to latch onto the plate handle 410. The latch 430 is anchored to the door 102 adjacent the window 110. In some alternative embodiments of the present invention, the latch 430 may be anchored to the ballistic shutter frame 420 or the wall near the door 102. Regardless of placement, the latch 430 is configured to secure the ballistic shutter member 400 over door window 110 in the ballistic shutter frame 420.

The securing bracket 300 is adapted to be secured to a wall adjacent to the door 102. One end of the bar 200 is pivotally attached to the bracket 300. The bracket 300 comprises a U-shaped bracket member comprising a first planar member 302 attached to the wall adjacent the door 102, a second planar member 304 extending transversely to the first planar member 302, and a third planar member 306 extending transversely to the second planar member and in parallel to the first planar member 302.

A pivot pin 310 extends through the third planar member 306 and is secured to the bar 200. The pivot pin 310 defines a pivot axis for the bar 200, allowing the secured end 202 of the bar 200 to pivot between a position extending substantially vertically along the door 102, as shown in FIGS. 1A and 1B to a position extending horizontally across the door 102, as shown in FIG. 1C.

The third planar member 306 of the securing bracket 300, is provided with an opening 320, which receives a release pin 340 therein. The release pin 340 is adapted to support the secured end 202 of the bar 200 in a vertical stored position within the securing bracket 300. The release pin 340 extends through the third planar member 306 transversely to the third planar member 306 into the U-shaped space defined by the bracket 300 and contact one side surface of the bar 200.

A release pin cable 330 is attached to one end of the release pin 340; and a second end of the release pin cable 330 is secured to the second planar member 304. When the bar 200 rests in the bracket 300, as shown in FIGS. 1A, 1B, 2A, and 2B, the release pin 340 extends through the bracket 300. When the system 100 is activated and the bar 200 is pivoted across the door 102, the release pin 340 is withdrawn from the opening 320 and is suspended by the release pin cable 330, as shown in FIGS. 1C and 2C.

In cases such as a double-wide door wherein the bar 200 may be too long to store upright, the bar 200 may be extendable in a locking fashion and retractable in a non-locking fashion. In each case, the release pin 340, secures the bar 200 in place when the bar 200 is not engaged across the doorway. The release pin 340 secures the bar 200 in place, by preventing it from pivoting around the fixed pivot pin 310.

A bar-receiving support holster 210 is secured on about the same horizontal level as the securing bracket 300, on opposite side of the door 102. The support holster is configured to receive a free end 204 of the bar 200 when the bar 200 is moved into an active position barring the door 102. The holster 210 defines a receptacle with an upwardly facing, open channel 212 for the bar 200; it is configured to receive and house the free end 204 of the bar 200 and prevent the bar 200 from pivoting further downwardly about the pivot pin 310.

The holster 210 has upwardly extending sides 214 and 216; the side 214 is used as an attachment plate for attaching the holster to the room wall near the door 102, while the side 216 stops movement of the bar 200 if pushing force is applied to the door during an active status of the system. A bottom part 218 of the holster 210 allows the bar 200 to rest within the holster 210 and prevents its downward movement within the channel 212.

However, the bar holster 210 is not necessary for this system, as the bracket 300 may be fitted to support the bar 200 in a horizontal position. Other preferred embodiments of the invention have a bar which is positioned near the door 102 against the wall when disengaged and wherein the holster bracket 210 is duplicated on the opposite side of the door 102 to allow the bar 200 to lay across door 100 when engaged.

Other preferred embodiments may have a holster bracket that provides support in four directions or may forgo holster bracket 210 altogether if the securing bracket 300 only allows for a limited range of pivot motion. Other preferred embodiment the release pin 340 may act as a locking pivot point, eliminating the need for a fixed pivot pin 310 and making the bar 200 detachable.

In use, the system is usually disengaged and is in a stored position shown in FIG. 1A and FIG. 2A. In this position, the bar 200 is pivotally connected to the wall near the door 102 and rests in a vertical orientation. The securing bracket 300 maintains the bar 200 in the normally vertical position using the release pin 340. The shutter member 400 is positioned next to, but not covering, the door window 110. The latch 430 is in a disengaged position on the door 102.

When an emergency arises, the system 100 is activated by one or more room occupants. FIGS. 1B and 2B depict a perspective view of a preferred embodiment of the present invention in a partly engaged state where ballistic shutter member 400 has been moved within the ballistic shutter frame 420 and latched by the rotating latch 430 so that it latches the handle 410 thus holding the ballistic shutter member 400 in place over the window 110. The shutter member 400 completely covers the window 110 and prevents a would-be intruder to see inside the classroom. It will be understood that although the shutter may be closed first in the preferred method of operating the present invention, in some cases the bar 200 will be lowered before the ballistic shutter 400 is engaged.

FIGS. 1C and 2C show a perspective view of a preferred embodiment of the present invention in a fully engaged state. In this active position, the release pin 340 has been withdrawn from the bracket 300 allowing the bar to pivot about the pivot pin 310 in the bracket 300. The bar 200 has been pivoted into engagement with the holster 210. The bar 200 lays across the door 102 preventing entry into room in manner not wholly dependent on door hinge or lock integrity, being held in place by the holster bracket 210 and the securing bracket 300, both of which are firmly anchored to the room wall. The bar 200 laying across the doorway in this manner also supports hinge and lock integrity by further preventing travel of the door in a way that would compromise lock or hinge integrity.

Many changes and modifications can be made in the security system according to the present invention without departing from the spirit thereof. We therefore pray that our rights to the present invention be limited only by the scope of the appended claims.

We claim:

1. A barricade apparatus for reinforcing a door having a window formed in the door, said apparatus comprising:

(i) a window shutter assembly configured for mounting on the door over the window, the shutter assembly comprising a laterally slidable shutter member; and (ii) a barricade bar assembly secured adjacent the door, the barricade bar assembly comprising a pivotable elongated bar sized to extend across an entire width of the door, a securing bracket configured for attachment to a wall, outside of a door frame, on one side of the door and pivotally supporting one end of the bar, and a holster configured for mounting on the wall, outside of the door frame, on an opposite side of the door in alignment with the securing bracket, the holster being configured to receive a second end of the bar when the bar is pivoted to extend across the door.

2. The barricade apparatus of claim 1, wherein the window shutter assembly and the barricade bar assembly are formed from a ballistic resistant material having a ballistic resistance equivalent to or greater than a UL level 3 ballistic rating.

3. The barricade apparatus of claim 1, wherein the securing bracket comprises a U-shaped bracket member having a first planar member configured for attachment to the wall adjacent the door, a second planar member extending transversely to the first planar member, and a third planar member extending transversely to the second planar member and in parallel to the first planar member, and wherein a pivot pin extends through the third planar member and is secured to the elongated bar, the pivot pin defining a pivot axis for the elongated bar and allowing a secured end of the elongated bar to pivot between a position extending substantially vertically along the door to a position extending horizontally across the door.

4. The apparatus of claim 3, wherein the third planar member of the securing bracket is provided with an opening, and wherein a release pin is removably positioned therein, the release pin being adapted to support the secured end of the elongated bar in a vertical stored position within the securing bracket, and wherein the elongated bar is configured to pivot about the pivot pin when the release pin is removed from the securing bracket.

5. The apparatus of claim 4, wherein the release pin extends through and transversely to, the third planar member into the U-shaped space defined by the securing bracket, while contacting one side surface of the elongated bar.

6. The apparatus of claim 5, comprising a release pin cable having a first cable end attached to one end of the release pin and having a second cable end secured to the second planar member, the release pin cable retaining the release pin in a position suspended from the securing bracket when the release pin is removed from the securing bracket.

7. The apparatus of claim 3, wherein the holster defines a receptacle with an upwardly facing, open channel configured to receive and house a free end of the elongated bar and prevent the elongated bar from pivoting downwardly about the pivot pin.

8. The apparatus of claim 7, wherein the holster comprises upwardly extending a first holster side and a second holster side extending in parallel to the first holster side, the first holster side being attached to the wall adjacent the door, and the second holster side acting to resist pushing force applied to the door during an active status of the barricade apparatus.

9. The apparatus of claim 8, said holster comprising a bottom part allowing the elongated bar to rest within the holster and preventing downward movement of the elongated bar within the open channel of the holster.

10. The apparatus of claim 1, wherein the window shutter assembly further comprises a shutter handle attached to the shutter member, and a shutter frame mounted on the door in a surrounding relationship to the window, the shutter frame supporting the shutter member in a sliding relationship within the shutter frame between an active position covering the window and a stored position away from the window.

11. The apparatus of claim 10, wherein the shutter assembly further comprises a latch anchored to the door adjacent the window and the frame, the latch being configured to engage the shutter handle when the shutter member is in the active position covering the window and prevent lateral sliding movement of the shutter member by securing the shutter member over the window in the shutter frame.

12. A barricade apparatus for reinforcing a door having a window formed in the door, said apparatus comprising:

(i) a window shutter assembly configured for mounting on the door over the window, the shutter assembly comprising a laterally slidable shutter member, a shutter handle attached to the shutter member, and a shutter frame mounted on the door in a surrounding relationship to the window, the shutter frame supporting the shutter member in a sliding relationship within the shutter frame between an active position covering the window and a stored position away from the window; and (ii) a barricade bar assembly secured adjacent the door, the barricade bar assembly comprising a pivotable elongated bar sized to extend across an entire width of the door, a securing bracket configured for attachment to a wall, outside of a door frame, on one side of the door and pivotally supporting one end of the bar, and a holster configured for mounting on the wall, outside of the door frame, on an opposite side of the door in alignment with the securing bracket, the holster being configured to receive a second end of the bar when the bar is pivoted to extend across the door.

13. The apparatus of claim 12, the shutter assembly further comprising a latch anchored to the door adjacent the window and the frame, the latch being configured to engage the shutter handle when the shutter member is in the active position covering the window and prevent lateral sliding movement of the shutter member by securing the shutter member over the window in the shutter frame.

14. The apparatus of claim 12, wherein the securing bracket comprises a U-shaped bracket member having a first planar member configured for attachment to the wall adjacent the door, a second planar member extending transversely to the first planar member, and a third planar member extending transversely to the second planar member and in parallel to the first planar member, and wherein a pivot pin extends through the third planar member and is secured to the elongated bar, the pivot pin defining a pivot axis for the elongated bar and allowing a secured end of the elongated bar to pivot between a position extending substantially vertically along the door to a position extending horizontally across the door.

15. The apparatus of claim 14, wherein the third planar member of the securing bracket is provided with an opening, and wherein a release pin is removably positioned therein, the release pin being adapted to support the secured end of the elongated bar in a vertical stored position within the securing bracket, the release pin extending through and transversely to, the third planar member into the U-shaped space defined by the securing bracket, while contacting one side surface of the elongated bar, and wherein the elongated bar is configured to pivot about the pivot pin when the release pin is removed from the securing bracket.

16. The apparatus of claim 14, wherein the holster defines a receptacle with an upwardly facing, open channel configured to receive and house a free end of the elongated bar and prevent the elongated bar from pivoting downwardly about the pivot pin, the holster comprising upwardly extending a first holster side, a second holster side extending in parallel to the first holster side, the first holster side being attached to the wall adjacent the door, and the second holster side acting to resist pushing force applied to the door during an active status of the barricade apparatus, the holster further comprising a bottom part allowing the elongated bar to rest within the holster and preventing downward movement of the elongated bar within the open channel of the holster.

17. A method of reinforcing a door having a window formed in the door during a shooting incident, comprising the steps:

(i) providing a window shutter assembly configured for mounting on the door over the window, the shutter assembly comprising a shutter frame mounted in a surrounding relationship over the window and a laterally slidable shutter member slidably received in the shutter frame;

(ii) providing a barricade bar assembly secured adjacent the door, the barricade bar assembly comprising a pivotable elongated bar, a securing bracket having a pivot pin and configured for attachment to a wall outside of a door frame on one side of the door, the securing bracket pivotally supporting one end of the bar while the bar is positioned in a normally vertical stored position, and a holster configured for mounting to a wall outside of a door frame on an opposite side of the door in alignment with the securing bracket;

(iii) during a shooting incident, slidably laterally moving the shutter member to a position covering the window and pivotally moving the bar and lowering a free end of the bar into engagement with the holster, thereby reinforcing the door independently of door hinges and door frame.

18. The method of claim 17, further comprising a step of providing a release pin removably positioned in the securing bracket, the release pin being adapted to support the secured end of the elongated bar in a vertical stored position while contacting one side surface of the elongated bar, and wherein the method comprises a step of removing the release pin and allowing the bar to pivot about the pivot pin prior to engaging the free end of the bar in the holster.

19. The method of claim 17, further comprising a step of providing a shutter latch anchored to the door adjacent the window and the frame, providing a shutter handle on the shutter member, the method comprising a step of engaging the latch with the shutter handle after the shutter member has been moved into an active position covering the window and prevent lateral sliding movement of the shutter member by securing the shutter member over the window in the shutter frame.

20. The method of claim 17, comprising a step of forming the shutter assembly and the barricade bar assembly from a ballistic resistant material having a ballistic resistance equivalent to or greater than a UL level 3 ballistic rating.

* * * * *